US005391858A

United States Patent [19]

Tourangeau et al.

[11] Patent Number: 5,391,858

[45] Date of Patent: Feb. 21, 1995

[54] ICE DAM MELTING SYSTEM

[75] Inventors: Donald R. Tourangeau, Portland, Oreg.; Joseph Csizmazia, Ketchum, Id.

[73] Assignee: Tourangeau Sprots Incorporated, Beaverton, Oreg.

[21] Appl. No.: 59,820

[22] Filed: May 10, 1993

[51] Int. Cl.[6] ..... H05B 1/00

[52] U.S. Cl. ..... 219/213; 52/173.1; 165/47; 392/436

[58] Field of Search ..... 219/213; 392/435, 436, 392/437; 165/47; 52/11, 12, 24, 173.1

[56] References Cited

U.S. PATENT DOCUMENTS

| | | | |
|---|---|---|---|
| 2,507,039 | 5/1950 | Miller | 219/213 |
| 3,129,316 | 4/1964 | Glass et al. | 219/213 |
| 3,303,324 | 2/1967 | Appleman | 392/436 |
| 3,388,738 | 6/1968 | Dery | 165/47 |
| 3,521,029 | 7/1970 | Toyooka et al. | 219/201 |
| 3,691,343 | 9/1972 | Norman | 219/213 |
| 3,725,638 | 4/1973 | Solin et al. | 219/213 |
| 3,784,783 | 1/1974 | Gray | 219/213 |
| 4,081,657 | 3/1978 | Stanford | 219/213 |
| 4,110,597 | 8/1978 | Elmore | 219/200 |
| 4,335,299 | 6/1982 | Belohlavek | 219/213 |
| 4,401,880 | 8/1988 | Eizenhoefer | 219/213 |
| 4,769,526 | 9/1988 | Taouil | 219/213 |
| 4,880,051 | 11/1989 | Ohashi | 165/47 |

FOREIGN PATENT DOCUMENTS

| | | | |
|---|---|---|---|
| 4-31575 | 2/1992 | Japan | 52/24 |
| 119447 | 5/1970 | Norway | 52/173.1 |
| 390047 | 3/1933 | United Kingdom | 392/436 |
| 971720 | 10/1964 | United Kingdom | 392/435 |

*Primary Examiner*—Geoffrey S. Evans
*Attorney, Agent, or Firm*—Kolisch, Hartwell, Dickinson, McCormack & Heuser

[57] ABSTRACT

An ice dam melting system includes a heat cell which is placed on a roof and which includes an upper panel, a lower panel which is spaced apart from the upper panel, and a conduit which extends in the space between the upper and lower panels. A heat generating mechanism is disposed in the conduit to provide heat to the heat cell.

15 Claims, 5 Drawing Sheets

ICE DAM MELTING SYSTEM

BACKGROUND OF THE INVENTION

This invention relates to an apparatus for melting frozen water off of a roof, and specifically to a system which will prevent or melt an ice dam formed on a roof.

An ice dam generally forms along the edge of a roof, possibly in conjunction with a gutter which extends along the roof eaves, or simply at the eaves of a roof. The ice dam forms as a result of water which accumulates on the roof, generally as the result of melting snow, travels along the surface of the roof, or possibly under the roofing material, reaches the edge of the roof and freezes.

It is typical in many parts of the world that two or three feet of snow may build up on a roof. The snow is a fairly good insulator. One way in which ice dams may form is on a roof which has inadequate insulation and is of what is referred to herein as single-roof construction. Any heat loss from the inside of the building will reach the exterior surface of the roof and melt a very thin layer of the snow, forming a snow-water interface between the exterior surface of the roof and the lower surface of the snow. The water does not refreeze because it is insulated by the snow, and proceeds to run down the roof until it reaches the edge of the roof at the eaves. At this point, if the ambient temperature is below freezing, the water will freeze and begin the formation of an ice dam. As water continues to flow down the roof under the snow, it reaches the now-forming ice dam and the dam continues to build in size. In some instances, an ice dam may build up to be a foot or more thick and extend up the roof six to eight feet. The formation of the ice dam prevents run off of water once the snow pack begins to melt, and can result in water being forced up under the roofing material, such as shingles, and, in extreme situations, run down through the roof sheeting under the exterior roofing material into the structure. Additionally, because the water and snow are retained on the roof, the weight build up can result in structural failure.

Such ice dams are, however, not limited to roofs which are not adequately insulted. A double-roof, referred to as a cold roof, is built with a vented air space between the primary roof and an exterior roof. This is supposed to prevent any building heat loss from reaching the exterior surface of the roof and generally is effective to prevent melting at the bottom of the snow layer as the result of escaping heat. However, as the ambient temperature reaches the upper twenties and low thirties (°F.), snow begins to melt along the roof peak, and forms a water interface between the upper surface of the roof and the lower surface of the snow as previously discussed, and forms an ice dam at the eaves of the roof.

Another possible way that an ice dam may form is on a roof which does not overlay an interior structure of the building, but which may abut a vertical south or west facing wall, which is possibly warmed by afternoon sun. Such is the case where a building entry roof or awning is provided, with or without a cold roof design, and the roof exterior surface of the roof is simply heated by conduction from the walls.

Regardless of how an ice dam forms, the presence of the ice dam, icicles and overhanging snow cornices is extremely dangerous to passersby, as they may be struck by falling ice and snow and seriously injured.

Additionally, the formation of an ice dam can result in serious structural damage to a building.

SUMMARY OF THE INVENTION

The ice dam melting system of the invention includes a heat cell which is placed on a roof and which includes an upper panel, generally formed of metal, a lower panel which is spaced apart from the upper panel, and a conduit which extends in the space between the upper and lower panels. A heat generating mechanism is disposed in the conduit to provide heat to the heat cell. The presence of this heated cell prevents the formation of an ice dam and allows any water which is present as the result of melting snow to run off the edge of the roof. A variation of the heat cell includes extending the heat cell over the eaves of the roof and a further modification includes extending the cell into a rain gutter.

An object of the invention is to provide a heat cell for a roof which may be easily installed, either as a retrofit or on new construction.

Another object of the invention is to provide a heat cell which effectively prevent the formation of an ice dam or which will melt an already formed ice dam off of a roof.

A further object of the invention is to provide a heat cell which is aesthetically pleasing and which will not be damaged by the presence of large amounts of snow and/or ice.

These and other objects and advantages of the invention will be more fully apparent as the description which follows is read in connection with the drawings.

DETAILED DESCRIPTION OF THE PREFERRED EMBODIMENT

Figure 1:
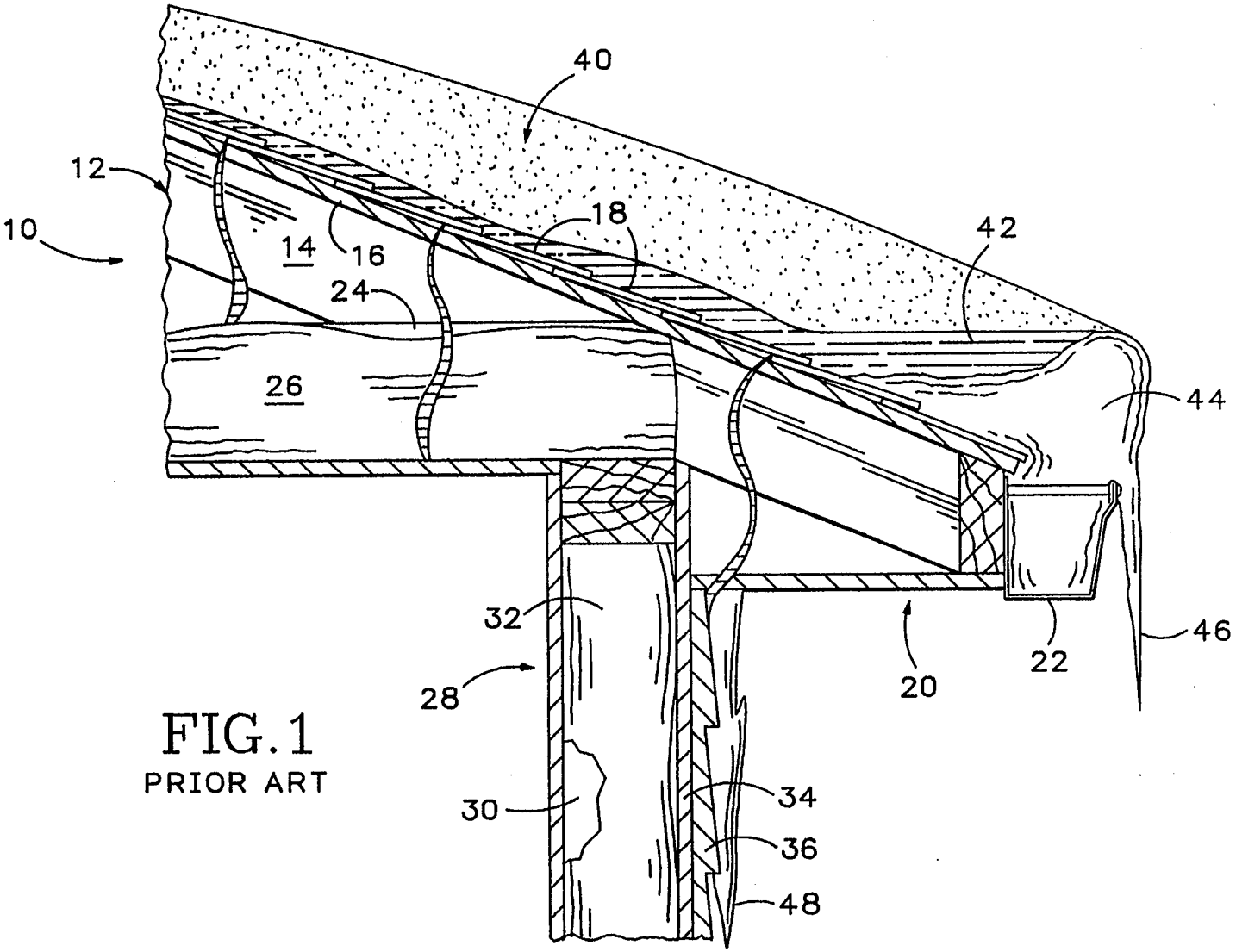
FIG. 1 PRIOR ART
FIG. 1 is a side elevation of an ice dam formed on a conventional roof.

Referring initially to FIG. 1, a roof environment is depicted that does not have the heat cell of the invention installed thereon. Structure 10 includes a conventional roof 12 which has roof joists 14, a sheeting layer 16 and shingles 18 thereon. The roof terminates at the edge of the structure in an eaves 20 which has a rain gutter 22 attached at the edge thereof. The remainder of the structure includes ceiling joists 24, roof and insulation 26 and support walls 28. The support walls include conventional studs 30, insulation 32, some form of external sheathing 34, and siding 36.

As depicted, a layer of snow 40 covers roof 12. Some of the snow has melted, to form a snow/water combination 42 which is being held on the roof by an ice dam 44. The ice dam extends over the eaves and into the rain gutter.

As depicted in the drawing, the snow/water region includes liquid water which, because it may not run off of the roof due to the presence of ice dam 44, is free to work its way under the shingles, through joints in the sheeting 16, whereupon it is able to enter the various insulation layers in the ceiling and walls. Additionally, as the snow/water layer freezes and thaws during the course of diurnal heating, it may loosen the shingles and sheeting on the roof, thereby physically damaging the roof structure itself. The water may also seep into the cornice area in the eaves where it will be trapped, and where its ultimate freezing and thawing will produce additional structural damage.

Figure 2:
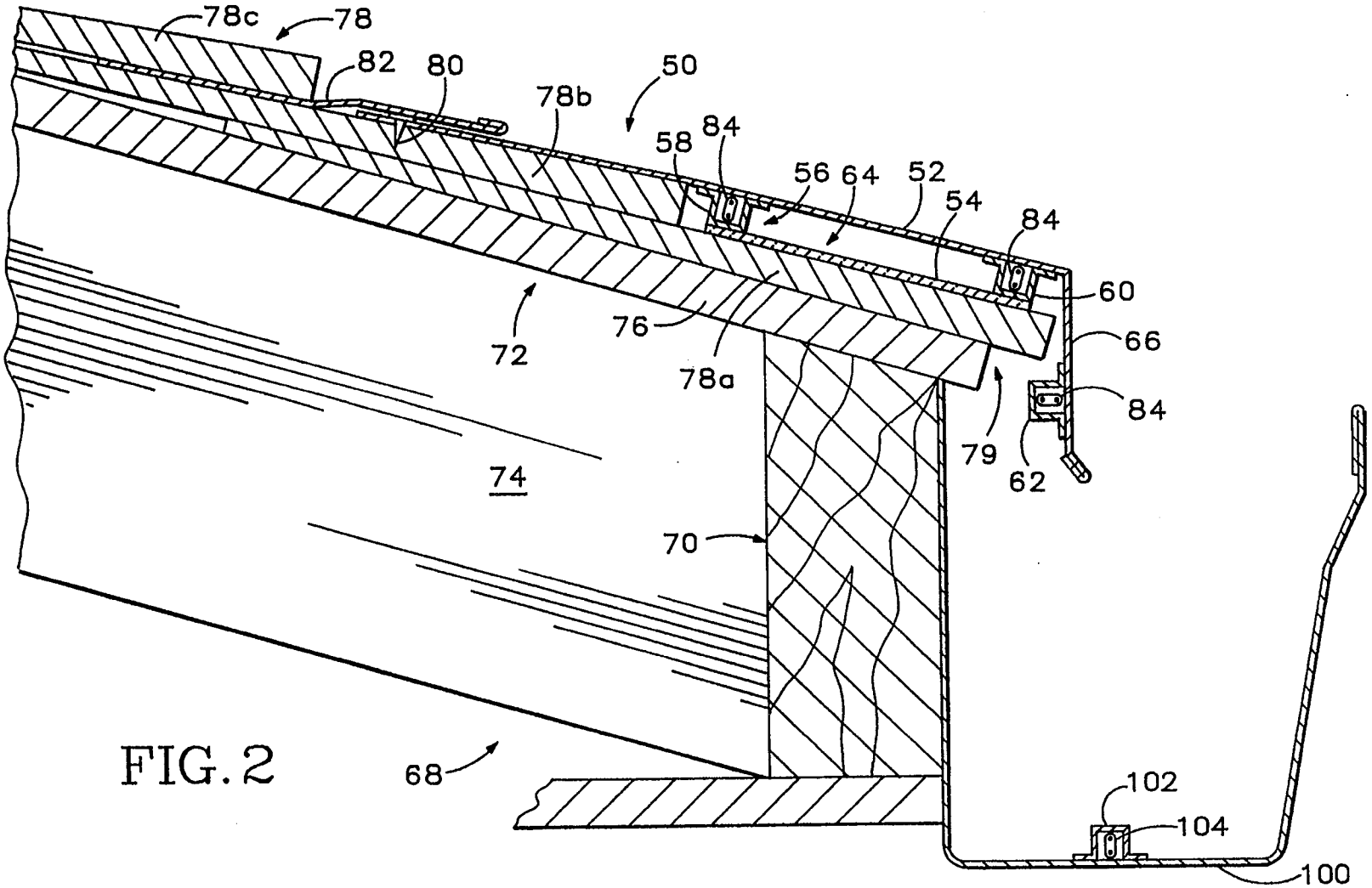
FIG. 2 is a side elevation of ice dam melting system constructed according to the invention, which is intended to be installed on an existing structure.
Figure 3:
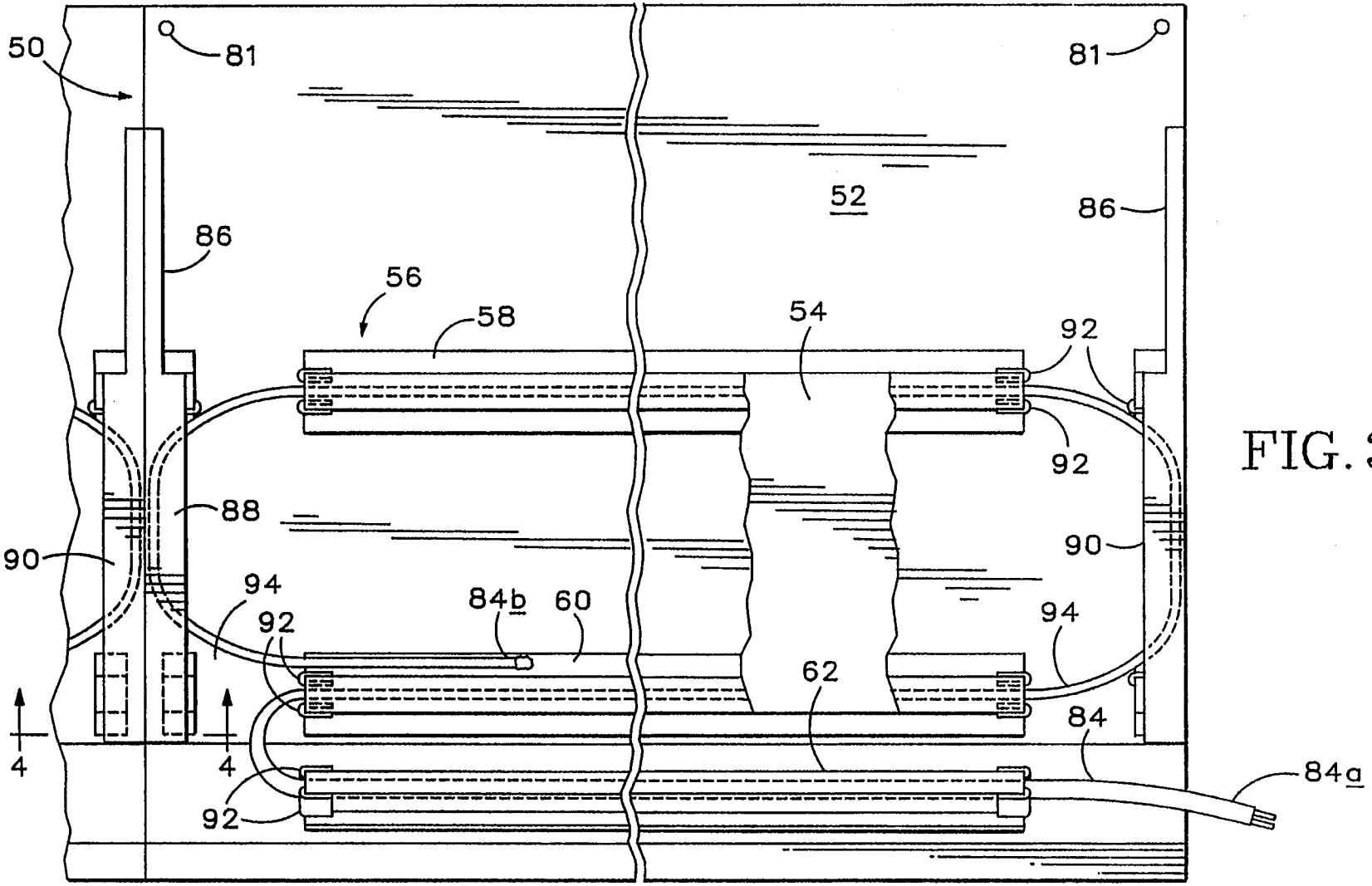
FIG. 3 is a bottom plan view of a heat cell of the invention.

Referring now to FIGS. 2 and 3, a heat cell constructed according to the invention is depicted generally at 50. Heat cell 50 includes, in the preferred embodiment, an upper panel 52, a lower panel 54, and a conduit, depicted generally at 56, which includes conduit elements 58, 60 and 62. A heated chamber 64 is formed between the spaced-apart upper and lower panels, and is bounded by conduit elements 58 and 60. Although lower panel 54 is provided in the preferred embodiment, the upper panel and the conduit may be fixed to the exterior surface of a roof and form chamber 64 therebetween. In the preferred embodiment, upper panel 52 includes a downwardly extending eaves portion 66 which carries conduit element 62 thereon.

Heat cell 50 is depicted as installed on an existing structure, depicted generally at 68. The structure includes a side wall 70 and a roof 72. Roof 72 includes a rafter 74, a roof decking portion 76, and some form of covering, such as shakes or shingles, which form the exterior roof 78. Roof eaves are indicted at 79. Roof 78 includes, in the embodiment depicted, courses of shingles, such as that represented at **78*a*, 78*b*, and 78*c***.

Heat cell 50 is constructed to cover the first course **78*a* of shingles with the upper panel 52 thereof extending over the second course 78*b*. The panel is secured to the roof by a fastener 80 which may be either a screw or a nail. A counter flashing 82 is provided and extends over the upper area of upper panel 52 and under the third course 78*c*** of shingles to provide a tight fit with the exterior roof.

An electric resistive, heat-generating cable 84 is trained through conduit 56 to provide heat to heat cell 50. Resistor cable 84 is of the self-regulating type and is connected to a power controller which will be described later herein. Cable 84 and the power controller comprise what is referred to herein as a heat-generating mechanism. Although the described heat-generating mechanism is believed to be the most efficient means of heating cell 50, it is possible to provide other forms of heat-generating mechanisms which will produce the same end result. Another feature of the heat cell of the invention is that cable 84 may be replaced should it begin to malfunction. The cable may be removed from the conduit and replaced with a like or similar cable.

To further describe heat cell 50, upper panel 52 may be formed of a metal, such as copper, galvanized steel or powder-coated aluminum. The cells are twenty to thirty inches deep and may be up to eight feet in length. The upper panel has a turned over edge 86 along each side thereof, and includes end conduit elements 88, 90 which provides both rigidity for the heat cell and a passageway for cable 84. Lower panel 54 is formed of a heat-reflective material which also has insulative properties.

Conduit 56, as previously noted, includes a number of conduit elements. These elements are formed by bending sheet metal stock in a hat-shaped form and welding, or otherwise securing, the "brim" to the upper panel, thereby providing a passageway for cable 84. As depicted in FIG. 3, a length of cable is threaded through the conduit for each panel. The free end of the cable **84*a* is attached to the power source, while the other end of the cable 84*b* is electrically insulated to prevent any short circuit. Plastic edge guards 92 are provided at the ends of the conduit segments to prevent abrasion of the cable. The conduit elements not only provide a enclosed area for the cable, but provide rigidity to the upper panel. The conduit elements generally extend the full length of the heat cell and include an open area, such as 94**, which is spaced apart from the edges of the heat cell to allow training of the cable through the conduit elements.

In the preferred embodiment, lower panel 54 is formed of a thermal blanket material, such as quilted mylar, and is affixed to the bottom surfaces of the conduit elements by adhesive or hook-and-loop fasteners. Alternately, a metal plate may be used for lower panel 54. In either construction, chamber 64 is formed between conduit elements 58 and 60 and side conduit elements 88 and 90 between upper panel 52 and lower panel 54. As cable 84 radiates heat, it heats the conduit elements and the upper panel and radiates from the sides of the conduits into chamber 64, thereby distributing the heat over upper panel 52, which distribution is effective to prevent the formation of an ice dam on the portion of the roof over which the heat cell is installed.

As noted in the background portion thereof, an additional problem with ice dams is the formation of an ice dam on the edge of a roof, as the result of water running off a relatively warm roof surface and freezing when it reaches the eaves, or forming icicles on the side of the eaves. To this end, downwardly extending portion 68 and conduit element 62 are provided to prevent the formation of icicles or an ice dam at the caves of the roof.

Referring again to FIG. 2, gutter 100 is depicted as being secured to the eaves of structure 68. When a gutter is provided, the gutter should be heated in order to prevent the formation of ice therein. A conduit 102 having a resistive cable 104 therein, extends the length of gutter 100 in the lower portion thereof. Cable 104 may be operated off of the same power controller as is cable 84.

Figures 4, 5:
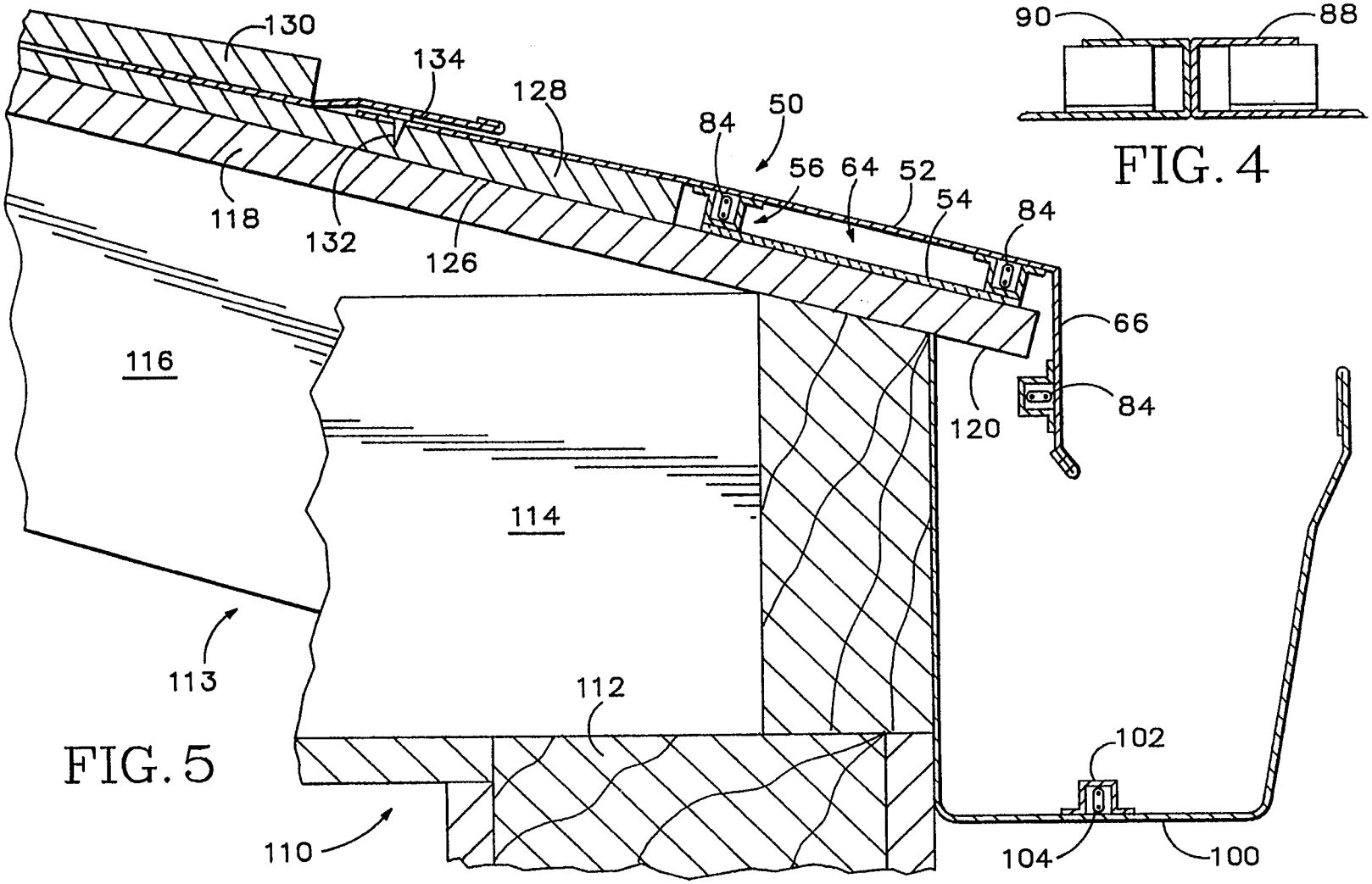
FIG. 4 is a front elevation section of a portion of the heat cell of the invention.
FIG. 5 is a side elevation of the invention installed on a new roof.

Referring now to FIG. 5, a method of installing the heat cell of the invention on a new roof construction will be described. A newly built structure 110 includes a side wall 112, which supports a roof structure 113 having roof joists 114, rafters 116 and roof decking 118. Roof structure 113 includes an eaves portion 120. In this instances, where existing shingles have not been placed on roof decking 118, heat cell 50 may be placed directly on the decking material, replacing the first course of shingles. In the actual installation, the first course area depicted generally at 124 is left bare, with decking 118 exposed. The second course area 126 is covered with a beveled member 128, which may be conventional beveled siding. This is done for the entire length of the roof. The third and subsequent course areas are covered with the roofing material, such as shingles, depicted at 130. After the exterior roof is complete, heat cells are installed along the length of the roof, with heated chamber 64 substantially filling course area 124. The heat cells are secured to the beveled member 128 with fasteners 132 and appropriate counter flashing 134 is then installed. Gutter 100, with conduit 102 and resistive cable 104 may then be installed.

Figure 6:
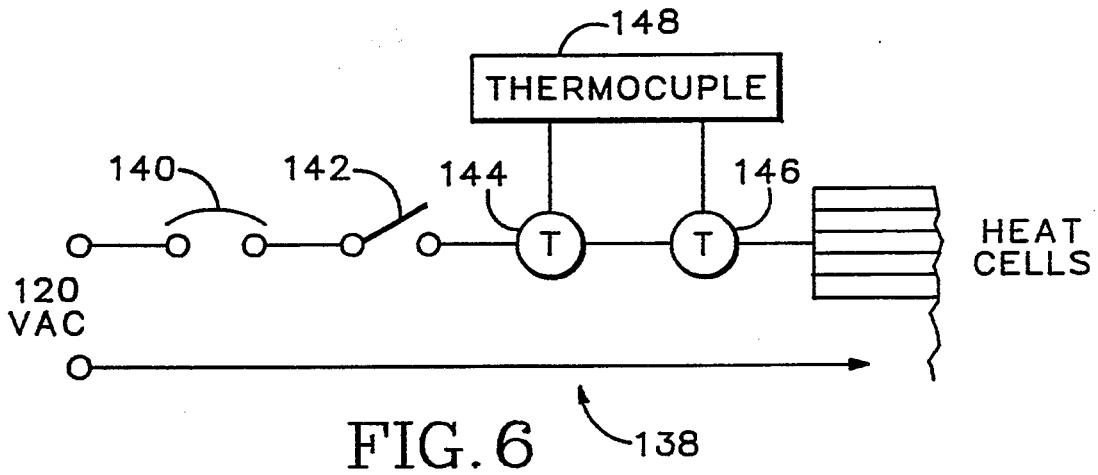
FIG. 6 is schematic diagram of a preferred embodiment of the electrical system for the system.

Referring now to FIG. 6, a power controller 138 for the resistive cable is depicted. The heat cell system is connected to standard 120 VAC house power, although for large installations, 240 VAC may be used. A ground fault interrupt 140 is provided. In the preferred embodiment, ground fault 140 is a 30 milliamp unit. An off/on switch 142 is provided to turn the system on or off.

A pair of thermostats 144, 146 are installed on the system and provide a "dead band" control which allows the system to operate only between two specified, or preselected, temperatures. For instance, thermostat 144 may be set to close above 0° F., while thermostat 146 may be set to close at 35° F. and open at 45° F. This type of a setting assumes that at temperatures below 0° F., there is generally little precipitation and that the critical ambient temperature for the formation of ice dams is between 35° F. and 45° F. Thermostats 144 and 146 are connected to a thermocouple 148 which is located outside of the structure in the ambient atmosphere. Although it is possible to use a variety of control systems for the heat cells, such as timers, photo-sensors, etc., it is believed that the dead-band system described is preferable in that it relies solely on temperature as a determinant for operation, and will provide the most reliable control.

The resistive cable used in constructing heat cell 50 is a self-regulating cable which is marketed with the model designation BTX-101-CT by Bylin Industries. The cable has an output of ten watts per linear foot. A typical eight foot long panel, with an eaves portion and a gutter heater will use approximately forty feet of cable, and will therefore use 400 watts of electricity.

The system has proved effective to prevent the formation of ice dams under virtually all environmental conditions and has proven effective to provide for the melting of a snow pack which has fallen on top of the heat cell and to maintain the upper surface of the cell free of frozen precipitation once cleared. Under such circumstances, there is no way in which an ice dam will have an opportunity to form.

Although a preferred embodiment of the invention and two methods of installing the heat cell of the invention have been disclosed herein, it should be appreciated that further modifications and variations may be made thereto without departing from the scope of the invention as set forth in the appended claims.

We claim:

1. A heat cell for a roof comprising:
- a lower panel;
- a conduit connected to and supported by said lower panel;
- an upper panel which is formed of metal and connected to and supported by said conduit; and
- a heat-generating mechanism disposed in said conduit.

2. The cell of claim 1 wherein said conduit is secured to said upper panel in a serpentine pattern.

3. The cell of claim 1 wherein said heat generating mechanism includes a resistive, heat-generating cable.

4. The cell of claim 1 wherein said lower panel includes a heat reflective, metallic layer.

5. The cell of claim 1 wherein the cell is constructed and arranged to extend along the upper surface of a roof and to extend over the eaves thereof.

6. The cell of claim 5 wherein the cell includes an eaves extension which extends into a gutter which is trained along the eaves of the roof and which further includes a heating mechanism for the gutter.

7. The cell of claim 7 further comprising a power controller electrically connected to said heat generating mechanism.

8. The cell of claim 7 wherein said power controller includes means for providing dead-band control of said heat-generating mechanism between preselected temperatures.

9. A heat cell for a roof comprising
- an upper panel which is formed of metal;
- a conduit connected to and supporting said upper panel;
- a lower panel spaced apart from said upper panel and connected to said conduit, wherein said lower panel includes a heat reflective, metallic layer, and whereby a chamber is formed between said upper panel and said lower panel; and
- a heat-generating cable disposed in said conduit.

10. The cell of claim 9 wherein said conduit is secured to said upper panel in a serpentine pattern.

11. The cell of claim 9 wherein the cell is constructed and arranged to extend along the upper surface of a roof and to extend over the eaves thereof.

12. The cell of claim 11 wherein the cell extends into a gutter which is trained along the eaves of the roof and which includes a heating mechanism for the gutter.

13. The cell of claim 9 which includes a power controller for said heat generating cable, wherein said power source includes dual thermostats for providing a dead-band heat control.

14. A heat cell for use on a roof having an upper surface and eaves, the heat cell comprising:
- a conduit arranged to be operatively connected to and supported by the upper surface of the roof, and arranged in a serpentine pattern;
- an upper panel attached to and supported by said conduit so that, when said conduit is supported by the roof, said upper panel is spaced apart from the upper surface of the roof; and
- a heat-generating mechanism disposed in said conduit.

15. A heat cell for use on a roof having an upper surface, eaves and a gutter which is trained along the eaves of the roof, the heat cell comprising:
- a conduit operatively connected to and supported by the upper surface of the roof;
- an upper panel attached to and supported by said conduit, spaced apart from the upper surface of the roof and including a downwardly extending eaves portion arranged to extend over the eaves of the roof; and
- a heat-generating mechanism disposed in said conduit and disposed in the gutter.

* * * * *